US008661944B2

(12) United States Patent
Wood

(10) Patent No.: US 8,661,944 B2
(45) Date of Patent: Mar. 4, 2014

(54) NAIL PLACEMENT DEVICE

(76) Inventor: Duggan Wood, Lubbock, TX (US)

( * ) Notice: Subject to any disclaimer, the term of this patent is extended or adjusted under 35 U.S.C. 154(b) by 247 days.

(21) Appl. No.: 13/209,416

(22) Filed: Aug. 14, 2011

(65) Prior Publication Data

US 2013/0036873 A1 Feb. 14, 2013

(51) Int. Cl.
*B25C 3/00* (2006.01)
*B25C 7/00* (2006.01)

(52) U.S. Cl.
USPC ..... 81/44; 227/113

(58) Field of Classification Search
USPC ..... 81/44, 23, 24, 27; 227/113, 146, 147
See application file for complete search history.

(56) References Cited

U.S. PATENT DOCUMENTS 3,342,228 A * 9/1967 Reid ..... 81/44
3,391,842 A * 7/1968 Mathes ..... 227/147
3,979,040 A * 9/1976 Denin ..... 227/113
4,065,045 A * 12/1977 Pray ..... 227/147
4,120,438 A * 10/1978 Litch ..... 227/147
4,483,475 A * 11/1984 Whitaker ..... 227/147
4,562,948 A * 1/1986 Floyd ..... 227/147
5,123,584 A * 6/1992 Harrison ..... 227/147
5,605,271 A * 2/1997 Russell ..... 227/147
5,875,950 A * 3/1999 Nuss et al. ..... 227/113
5,921,456 A * 7/1999 Kirsch et al. ..... 227/147
6,871,568 B2 * 3/2005 Chen ..... 81/44
6,951,153 B2 * 10/2005 Berthlaume ..... 81/44
8,201,481 B2 * 6/2012 Williams ..... 81/44
2002/0100789 A1 * 8/2002 Schrank ..... 227/147
2007/0051208 A1 * 3/2007 Stephens ..... 81/44
2010/0127036 A1 * 5/2010 Marschel et al. ..... 227/146
2011/0214536 A1 * 9/2011 Williams ..... 81/44
2011/0219915 A1 * 9/2011 Mingo ..... 81/44

* cited by examiner

*Primary Examiner* — David B Thomas
(74) *Attorney, Agent, or Firm* — The Law Offices of Jerry D. Haynes

(57) ABSTRACT

The present invention is a nail placement device that includes an enter rod that allows the device to extend into a confined area wherein the enter rod's diameter forms an indentation on the distal end of the enter rod and a magnetic tip disposed on the distal end of the enter rod that secures a nail to be sunk into a desired surface within the relatively confined area. The device also includes an inner rod that receives the proximal end portion of the enter rod that is weighted that enhances any force utilized to set the nail with the device and an ergonomically designed handle to accommodate the user's fingers and a raised distal end to prevent the user's fingers and grasping hand from sliding off of the handle while utilizing the device.

7 Claims, 1 Drawing Sheet

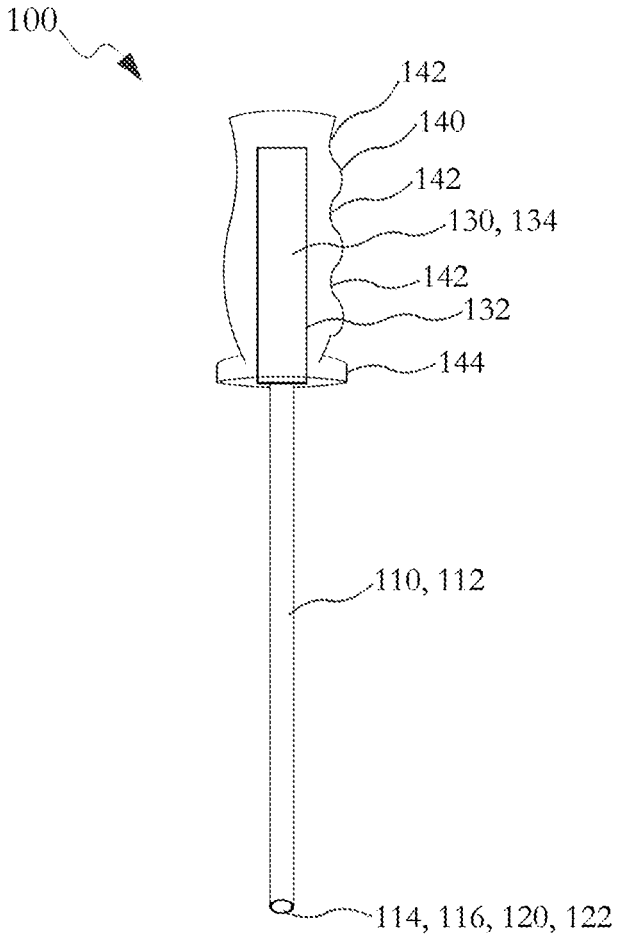
100
142
140
142
130, 134
142
132
144
110, 112
114, 116, 120, 122

NAIL PLACEMENT DEVICE

TECHNICAL FIELD & BACKGROUND

Individuals must often place nails in hard to reach areas. Conventional hammers may be difficult or impossible to swing in small quarters or confined quarters, where having to hold the nail in place with their free hand may cause a user to strike their fingers.

The present invention generally relates to a hardware device. More specifically, the invention is a nail placement device.

It is an object of the invention to provide a nail placement device that allows a user to sink a nail into a surface in a tightly-confined environment.

It is an object of the invention to provide a nail placement device that allows a user to sink a nail into a surface in an environment where a traditional hammer could not be swung.

It is an object of the invention to provide a nail placement device that prevents a user from striking their fingers with a hammer while trying to sink a nail into a surface in a tightly-confined environment or anywhere else.

What is really needed is a nail placement device that allows a user to sink a nail into a surface in a tightly-confined environment that allows the user to sink a nail into a surface in an environment where a traditional hammer could not be swung and that prevents the user from striking their fingers with a hammer while trying to sink a nail into a surface in a tightly-confined environment.

BRIEF DESCRIPTION OF THE DRAWINGS

The present invention will be described by way of exemplary embodiments, but not limitations, illustrated in the accompanying drawings in which like references denote similar elements, and in which:

FIG. 1 illustrates a side perspective view of a nail placement device, in accordance with one embodiment of the present invention.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is utilized repeatedly. The phrase generally does not refer to the same embodiment, however, it may. The terms "comprising", "having" and "including" are synonymous, unless the context dictates otherwise.

FIG. 1 illustrates a side perspective view of a nail placement device 100, in accordance with one embodiment of the present invention.

The nail placement device 100 includes an enter rod 110, a magnetic tip 120, an inner rod 130 and a handle 140. The user applies weight and force to the nail placement device 100 to drive a nail into a desired surface in a relatively confined area where swinging a hammer to sink the nail is not possible.

The enter rod 110 is a generally elongated pipe 112 and is typically made of steel or copper, but can be made of other suitable materials. The enter rod 110 allows the nail placement device 100 to extend into a relatively confined area to sink a nail in the relatively confined area where swinging a hammer to sink a nail is not possible. The enter rod 110 can accommodate a nail with a variety of suitable lengths as well. The enter rod 110 has a diameter 114 that forms an indentation 116 that can accommodate a variety of nail diameters. The enter rod 110 is approximately 26 inches in length and ⅜ths of an inch in diameter, but can be other suitable dimensions as well. The enter rod 110 can be made of steel or copper or any other suitable material. The magnetic tip 120 is disposed on the distal end 114 of the enter rod 110 within the indentation 116 to facilitate in securing a nail (not shown) in place on the magnetic tip 120. The magnetic tip 120 is made of magnetic material 122 that is strong enough to hold the nail in place to be sunk into a desired surface within the relatively confined area where swinging a hammer to sink the nail is not possible. The inner rod 130 permanently receives a proximal end portion 116 of the enter rod 110 and is relatively shorter in length than the enter rod 110. The inner rod 130 is also weighted with a weighted material 134 that typically is in the range of 12 to 16 ounces, although other suitable weighting material weights can also be utilized. The weighted material 134 enhances any force that is utilized to set a nail with the nail placement device 100. The handle 140 is disposed over the outer surface 132 of the inner rod 130 and is ergonomically designed with a plurality of inwardly curved indentations 142 to accommodate a user's fingers. The handle 140 also has a raised distal end 144 to prevent the user's fingers and gripping hand from sliding off of the handle 140 and onto the inner rod 130 while utilizing the nail placement device 100. The handle 140 is also made of slip resistant rubber or relatively hard plastic material to further enhance gripping capability.

The nail placement device includes an approximate 26" long steel rod inserted into a slightly larger pipe covered by a rubber or hard plastic handle. The nail placement device is relatively easier to use than other similar nail placement devices. Once a nail has been inserted into the distal end of the enter rod, the user simply places one hand on the pipe and the other on the handle and utilizes applied force and weight to drive the nail into place. The nail placement device will be readily available in a variety of sizes in order to suit any and all sizes of nails. Among those who will find the nail placement device both convenient and useful are hardware manufacturers, individuals in the construction field as well as the everyday user, especially a do-it-yourselfer type of everyday user. The nail placement device features a steel rod inserted into a larger rod, allowing users to drive a nail into the desired area with relatively less effort than other nail placement devices. The nail placement device is designed with a magnetic tip in order to effectively secure the nail in place on the distal end and is also afforded a weighted handle with a non-slip comfort grip. The nail placement device can also be used any place a nail needs to be driven who is not skilled with a hammer and nail. The magnetic tip goes on the inner rod tip. To hold the nail, as the user pulls up the handle up, the nail goes up the outer pipe. Sliding the handle down sets the nail and then driving the nail down with a pounding motion. The device is made in two pieces, the outer pipe and the handle and driving rod. The outer pipe is $1/16^{th}$ of an inch shorter than the driving rod.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A nail placement device utilized by a user with a plurality of fingers and a hand to grasp said device, comprising;

an enter rod with a diameter, a distal end, a proximal end portion and a generally elongated shape that allows said device to extend into a confined area wherein said diameter forms an indentation on said distal end of said enter rod;

a magnetic tip made of magnetic material disposed on said distal end of said enter rod that secures a nail to be sunk into a desired surface within said relatively confined area, where the distal end receives and covers a head of the nail;

an inner rod with an outer surface that receives said proximal end portion of said enter rod that is weighted with a weighted material that enhances any force utilized to set said nail with said device; and an ergonomically designed handled disposed over said outer surface of said inner rod that includes a plurality of inwardly curved indentations to accommodate said user's fingers and a raised distal end to prevent said user's fingers and said grasping hand from sliding off of said handle while utilizing said device.

2. The device according to claim 1, wherein said enter rod is made of steel.

3. The device according to claim 1, wherein said enter rod is made of copper.

4. The device according to claim 1, wherein said enter rod is approximately 26 inches in length and 3/8ths of an inch in diameter.

5. The device according to claim 1, wherein said weighted material weighs in the range of 12 to 16 ounces.

6. The device according to claim 1, wherein said handle is made of slip resistant rubber material to further facilitate grasping said device.

7. The device according to claim 1, wherein said handle is made of slip resistant hard plastic material.

* * * * *